US010748368B2

(12) United States Patent
Sackfield et al.

(10) Patent No.: US 10,748,368 B2
(45) Date of Patent: Aug. 18, 2020

(54) BANKNOTE VALIDATOR

(71) Applicant: Innovative Technology Limited, Oldham (GB)

(72) Inventors: Martin Sackfield, Oldham (GB); John Tillson, Oldham (GB); Daniel Russell, Oldham (GB); Paul Clark, Oldham (GB)

(73) Assignee: Innovative Technology Limited, Oldham (GB)

( * ) Notice: Subject to any disclaimer, the term of this patent is extended or adjusted under 35 U.S.C. 154(b) by 45 days.

(21) Appl. No.: 16/253,535

(22) Filed: Jan. 22, 2019

(65) Prior Publication Data

US 2019/0244464 A1 Aug. 8, 2019

(30) Foreign Application Priority Data

Feb. 5, 2018 (GB) ..... 1801827.5

(51) Int. Cl.

| | |
|---|---|
| ***G07D 11/16*** | (2019.01) |
| ***G07D 11/14*** | (2019.01) |
| ***B65H 5/02*** | (2006.01) |
| ***G07F 19/00*** | (2006.01) |
| ***B65H 7/14*** | (2006.01) |
| ***B65H 9/06*** | (2006.01) |
| ***G07D 11/125*** | (2019.01) |
| ***G07D 11/225*** | (2019.01) |
| ***G07D 7/121*** | (2016.01) |

(52) U.S. Cl.

CPC ..... *G07D 11/16* (2019.01); *B65H 5/025* (2013.01); *B65H 7/14* (2013.01); *B65H 9/06* (2013.01); *G07D 7/121* (2013.01); *G07D 11/125* (2019.01); *G07D 11/14* (2019.01); *G07D 11/225* (2019.01); *G07F 19/202* (2013.01); *B65H 2701/1912* (2013.01); *G07D 2207/00* (2013.01); *G07D 2211/00* (2013.01)

(58) Field of Classification Search

CPC .. G07D 11/16; G07D 11/125; G07D 11/0096; G07D 7/12; G07D 2211/00

See application file for complete search history.

(56) References Cited

U.S. PATENT DOCUMENTS

| | | | | |
|---|---|---|---|---|
| 3,485,358 A | | 12/1969 | Hooker | |
| 5,909,792 A | * | 6/1999 | Gerlier | G07D 7/128 194/206 |
| 6,918,482 B2 | * | 7/2005 | Thierauf | G07D 7/121 194/207 |

(Continued)

FOREIGN PATENT DOCUMENTS

| | | |
|---|---|---|
| EP | 0 497 359 A2 | 8/1992 |
| JP | 2005-4375 | 6/2005 |
| JP | 2007-299190 | 11/2007 |

*Primary Examiner* — Maurice C Smith

(74) *Attorney, Agent, or Firm* — Woodard Emhardt Henry Reeves & Wagner LLP

(57) ABSTRACT

A banknote validator having a housing, a validation sensor; and a banknote drive mechanism. The banknote drive mechanism may be arranged to transport a banknote from an input aperture to a stacking device. The banknote drive mechanism may delimit a first banknote pathway proximal to an input aperture, and a second banknote pathway proximal to the stacking device. A pivotable security gate arrangement may be included that is resiliently biased to project into the second banknote pathway.

12 Claims, 4 Drawing Sheets

(56) References Cited

U.S. PATENT DOCUMENTS

| | | | | |
|---|---|---|---|---|
| 7,912,272 | B2 * | 3/2011 | Joshi | G07D 7/1205 194/302 |
| 8,421,046 | B2 * | 4/2013 | Leuthold | G07D 7/12 134/37 |
| 8,531,652 | B2 * | 9/2013 | Haas | G07D 7/128 356/51 |
| 9,053,597 | B1 * | 6/2015 | Sackfield | B65H 29/58 |
| 2002/0108891 | A1 | 8/2002 | Dunlop et al. | |
| 2004/0233618 | A1 * | 11/2004 | Ashurst | G07D 11/165 361/600 |
| 2010/0270120 | A1 | 10/2010 | Nireki | |

* cited by examiner

BANKNOTE VALIDATOR

CROSS-REFERENCE TO RELATED APPLICATION

This application claims the foreign priority benefit of United Kingdom Patent Application No. 1801827.5 filed Feb. 5, 2018 which is hereby incorporated by reference.

FIELD OF THE INVENTION

The present invention generally relates to apparatus for receiving, storing and/or dispensing of banknotes, vouchers, coupons and the like. Specifically, the present invention relates to a banknote validator. It should be noted that the term "banknote" is non-limiting and used here to mean any item of paper currency, bill, voucher, ticket, card or sheet that may have a value, monetary or otherwise, or may be used to convey information.

BACKGROUND

There are many forms of banknote validation known in the art and there are numerous variants of conventional banknote validators.

An example of a prior art banknote validator is disclosed in EP-B-1,415,281. Here, the banknote validator comprises a housing including banknote validation sensor means, a banknote drive mechanism which circulates the banknote from a banknote input aperture, passed the banknote validation sensor means, to an underside section adjacent to stacking means and an attached cashbox for storing banknotes.

The banknote drive mechanism of EP-B-1,415,281 takes the form of a removable cassette including a drive motor and a pair of continuous drive belts which loop around the cassette.

A problem exists with the above mentioned prior art approach in that when a received banknote is transported around the drive mechanism to a position adjacent to the cashbox, the onboard processing means of the banknote validator cannot determine the position of the banknote prior to activation of a banknote stacking operation that urges the banknote into the cashbox. Consequently, a stacking operation may be instigated when a banknote is in an incorrect position, resulting in damage to the banknote or the occurrence of a mechanism jam.

In addition, a further issue arises with a conventional banknote validator as described in EP-B-1,415,281 in that if the banknote validator sensor means includes ultraviolet illumination for detecting visible fluorescence in banknotes, it is necessary to include additional elements into the sensor arrangement to facilitate the calibration of camera sensors. Also, EP-B-1,415,281 does not address the problem associated with banknote "strimming", where a tape or string attached to the banknote is used to extract the banknote from the validator input aperture after the banknote has been successfully authenticated by the banknote validator sensor means.

SUMMARY

It is an aim of the present invention to provide a banknote validator that overcomes the aforementioned problems. Moreover, the present invention arose from attempts in providing a banknote validator that improves the performance of banknote validation whilst minimising costs by employing solutions that minimise the number of required components.

According to an aspect of the present invention there is provided a banknote validator as defined in claim 1.

A second (lower) housing section includes an optical sensor disposed in the second banknote pathway at a position in the second banknote pathway distal from the pivotable security gate arrangement.

The second housing section includes a cashbox ingress aperture positioned between the pivotable security gate arrangement and the optical sensor.

The removable banknote module includes an illumination window positioned adjacent to the first banknote pathway, wherein the illumination window is transparent to both visible light and infrared radiation, and wherein the illumination window is configured to emit visible fluorescent light when irradiated by ultraviolet light.

The illumination window is constructed from a transparent polypropylene material that incorporates a visible fluorescence substance.

The optical sensor is formed by an arcuate transparent light conduit disposed adjacent to an end of the cashbox ingress aperture that is downstream in the second banknote pathway.

The pivotable gate arrangement is disposed proximal to an end of the cashbox ingress aperture that is upstream in the second banknote pathway.

A received banknote travelling along the second banknote pathway travels from an upstream position defined by the location of the pivotable security gate arrangement to a downstream position defined by the location of the optical light sensor.

The removable banknote drive module includes an auxiliary PCB including at least one processor, and a drive motor.

BRIEF DESCRIPTION OF THE DRAWINGS

An embodiment of the present invention will now be described, by way of example only, with reference to the accompanying drawings, in which.

DETAILED DESCRIPTION

Figure 1:
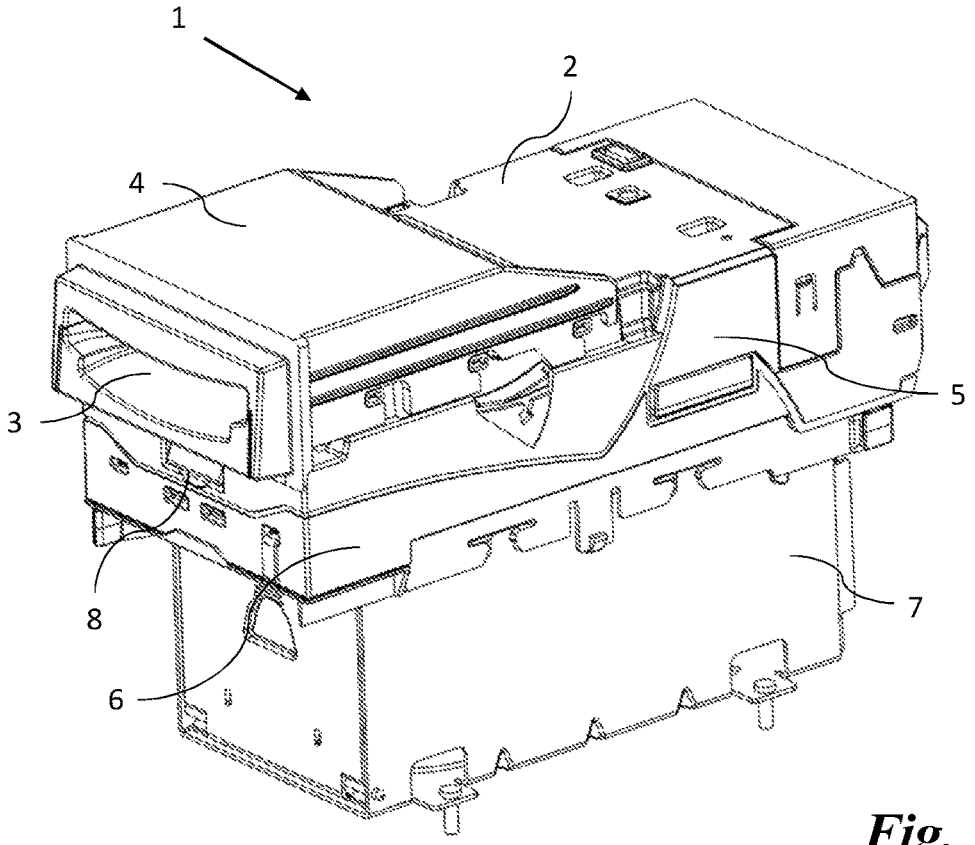
FIG. 1 shows a perspective view of an embodiment of the banknote validator of the present invention.

As shown in FIG. 1, a banknote validator 1 according to an embodiment of the present invention comprises an acceptor unit 2 releasably interconnected with a cashbox 7 for receiving and storing authenticated banknotes.

The acceptor unit 2 includes a removable bezel module 4 having a banknote input aperture 3 disposed on an upper front surface of the bezel module 4. The acceptor unit 2 comprises an upper housing section 5 and a lower housing section 6. The upper section 5 is pivotally connected to the lower housing section 6 via a pair of pivot lugs (see FIG. 3). When activated, a release mechanism 8 enables the upper housing section 5 to be released from the lower housing section 6 and to be swung upwards to reveal the enclosed banknote drive module 9 (see FIG. 2).

When both the upper housing section 5 and lower housing section 6 are locked in the closed position (FIGS. 1, 4 and 5), the banknote drive module 9 is sandwiched between the upper housing section 5 and the lower housing section 6 to form an upper banknote pathway 17 and lower banknote pathway 18. The upper banknote pathway 17 and the lower banknote pathway 18 communicate with one another to form a substantially u-shaped articulated pathway. The upper banknote pathway 17 is interconnected to, and communicates with, the input aperture 3, and an input banknote 28 travels in a direction 19 along the upper banknote pathway 17. The banknote travels in an arcuate direction 19' to enter the lower banknote pathway 18 (see FIG. 4).

The banknote drive module 9 will be described with reference to FIG. 2. The banknote drive module 9 is a lozenge-shaped cassette housing a drive motor (not shown) for driving a pair of continuous drive belts 10 via opposing pairs of drive wheels 11. The banknote drive module 9 encloses an auxiliary PCB 30 (see FIG. 6) which includes various surface-mount components and LEDs configured to control various operations of the banknote drive module 9. The combined components of the auxiliary PCB 30 can be considered to act as a controller for the banknote drive module 9. A communication and power interface 15 is provided for connection to a master PCB (not shown) housed within the upper housing section 5 of the acceptor unit 2.

The banknote drive module 9 includes a banknote attachment detection sensor 14 disposed laterally across the banknote path. The banknote attachment detection sensor 14 comprises an elongate light conduit disposed in a raised portion of the banknote pathway. Light from an LED source within the upper housing section 5 is directed along the light conduit. When a banknote passes this point in the banknote pathway, any string, tape or the like attached to the trailing edge of the banknote will break the light path and trigger the light receiver (not shown). In this way, the banknote acceptor unit 2 is alerted to a fraudulent strimming event.

Figure 2:
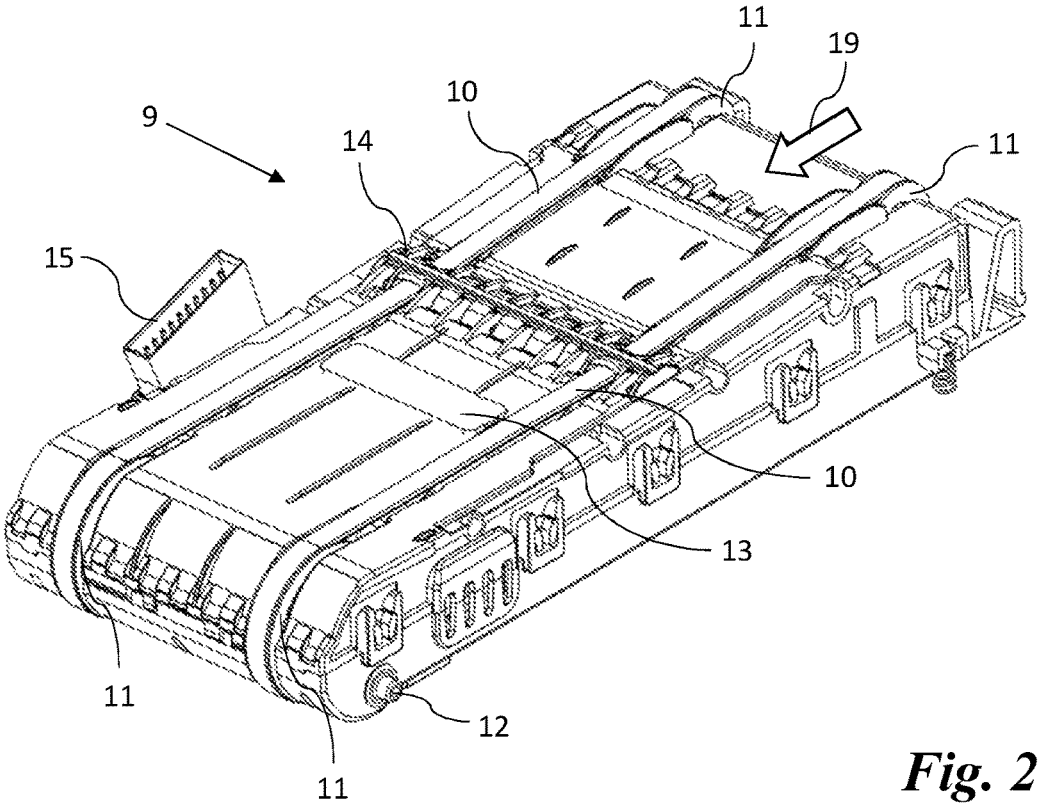
FIG. 2 shows a perspective view of the removable banknote drive module of the banknote validator shown in FIG. 1.

Also shown in FIG. 2 is an illumination window 13. The illumination window 13 spans the banknote pathway in a lateral direction, and is positioned downstream from the banknote attachment detection sensor 14 in the banknote input direction 19.

The illumination window 13 is fabricated from a transparent plastics material such as polypropylene. The illumination window 13 includes chemical additives which permit the window to fluoresce under illumination by ultraviolet light. However, the reader should be aware that the illumination window 13 can be constructed from any material that is transparent to visible and infrared light, whilst also including an ultraviolet fluorescent additive, such that when the illumination window 13 is illuminated with UV light it will fluoresce at least in the visible region of the electromagnetic spectrum.

Figure 3:
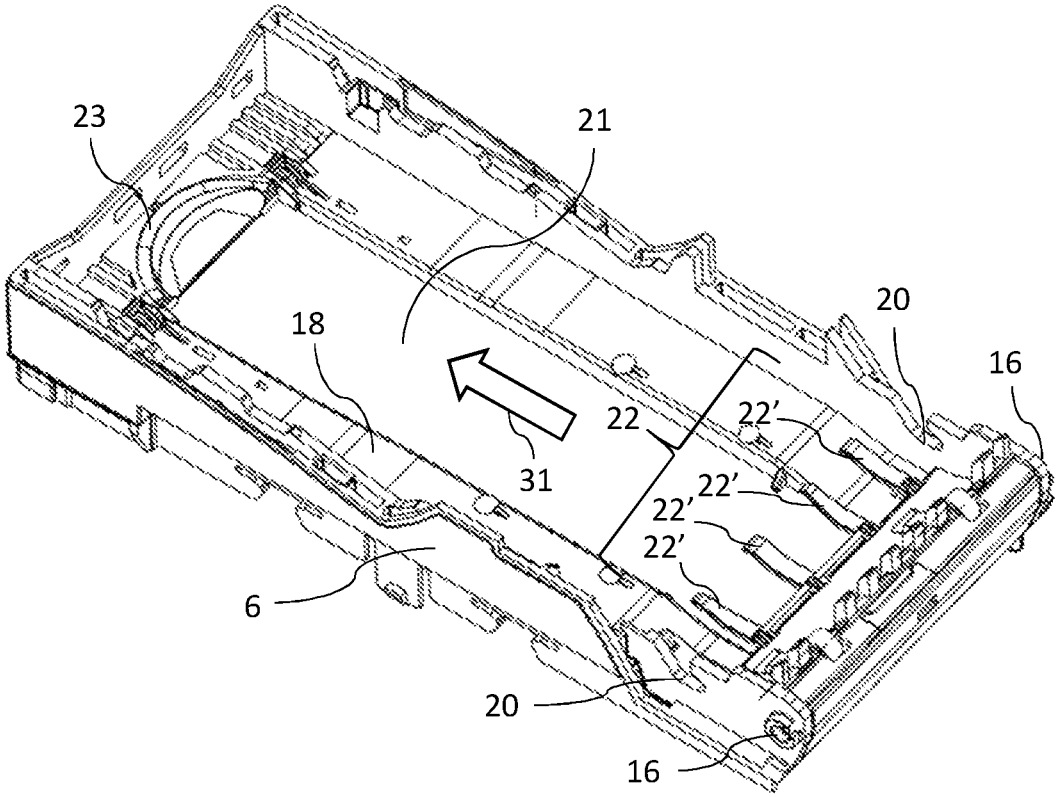
FIG. 3 shows a perspective view of the lower housing section of the banknote validator shown in FIG. 1.

FIG. 3 shows a perspective view of the lower housing section 6 with both the upper housing section 5 and the banknote drive module 9 removed.

As shown, the banknote direction 31 for the lower banknote pathway 18 is from right to left (as viewed in the diagram). A security gate 22 is positioned upstream in the lower banknote pathway 18. The security gate 22 comprises a plurality of security gate tines 22' distributed across the lateral expanse of the lower banknote pathway 18.

The security gate 22 is resiliently biased such that each of the security gate tines 22' is urged upwards (as viewed) in a direction substantially towards the upper housing section 5 (when in place). Consequently, the normal operating or biased position of the security gate tines 22' is to project into the lower banknote pathway 18.

Opposing the security gate 22 at a downstream position in the banknote direction 31 is an arcuate light conduit 22 that is seated in a recess of an upper surface of the lower banknote pathway 18. The arcuate light conduit 22 is formed from a transparent light pipe spanning the width of a cashbox ingress aperture 21. As will be well known to the reader, in use, the cashbox ingress aperture 21 aligns with a corresponding pusher-plate arrangement positioned in an underside surface of the banknote drive module 9. When activated, the pusher-plate arrangement is adapted to push a banknote 28 from the lower banknote pathway 18 into the cashbox 7 (see FIG. 4).

Figure 6:
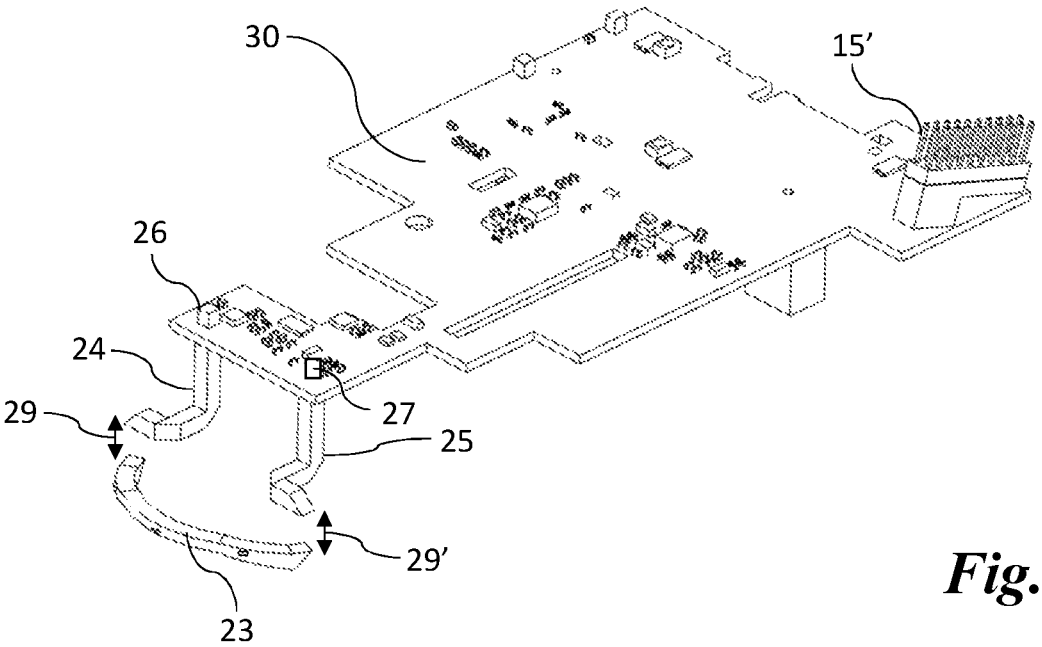
FIG. 6 is a perspective view of the banknote validator auxiliary PCB and associated sensor light conduits.

As shown in FIG. 6, the arcuate light conduit 23 forms part of a light sensor loop with the auxiliary PCB 30 via a light transmit conduit 24 and a light receive conduit 25. An LED 26 transmits through the light transmit conduit 24 and across a sensor gap 29 to enter the arcuate light conduit 23. The light in the arcuate light conduit 23 is guided around to the light receive conduit 25 via an opposing sensor gap 29'. Light from the light receive conduit 25 is received and detected by a light receiver 27.

When the leading edge of the banknote 28 reaches the arcuate light conduit 23 the light loop is broken, and the sensor arrangement is triggered. In this way the auxiliary PCB 30 receives information as to when the banknote 28 travelling in the direction 31 has reached the full extent of the lower banknote pathway 18.

Figure 4:
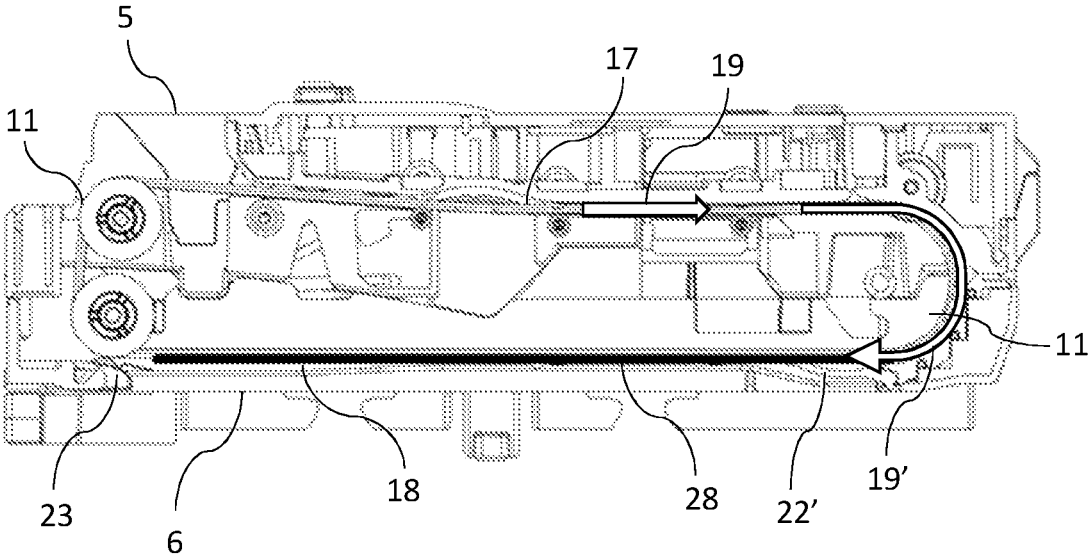
FIG. 4 shows a partial sectional view of the banknote validator of FIG. 1 with the security gate urged downwards by an incoming banknote.

With reference to FIG. 4, the banknote 28 which was received by the acceptor unit 2 travels in a direction 19 along the upper banknote pathway 17, travels around the drive wheels 11 in a direction 19' to enter the lower banknote pathway 18. On reaching the entrance to the lower banknote pathway 18, the leading edge of the banknote 28 urges the tines 22' of the security gate 22 downwards away from banknote drive module 9 to allow ingress of the entire banknote 28 into the lower banknote pathway 18.

Figure 5:
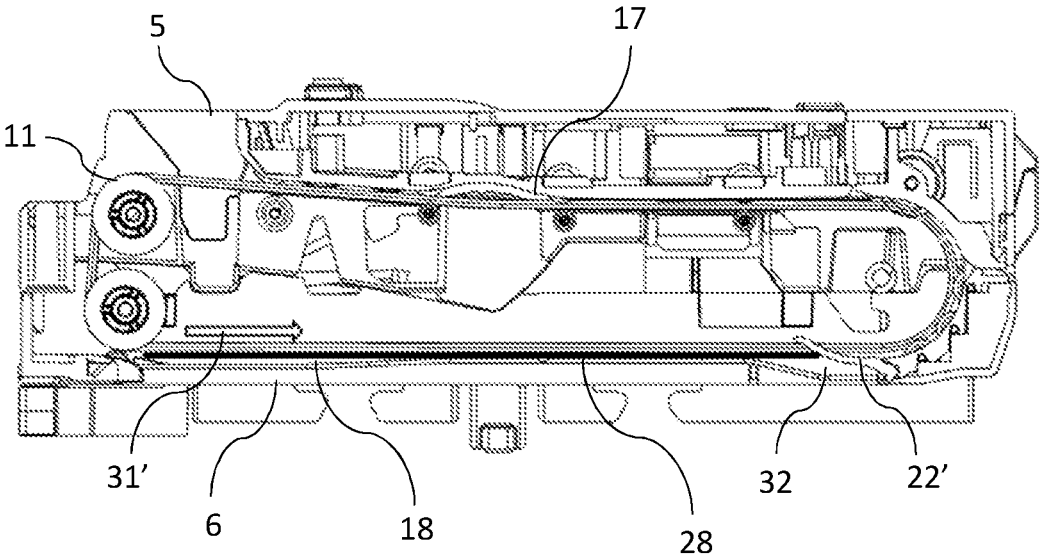
FIG. 5 shows a partial sectional view of the banknote validator of FIG. 1 with the security gate returned to its biased position after the incoming banknote has passed.

As shown in FIG. 5, once the trailing edge of the banknote 28 has passed the security gate 22, the tines 22' resile upwards to their biased position. In this way, access to the upstream entrance of the lower banknote pathway 18 becomes closed. A local light sensor positioned in the underside of the banknote drive module 9 proximal to the security gate 22 (not shown) detects opening and closing of the security gate 22. In this way, the auxiliary PCB 30 receives an indication as to when the leading edge of the banknote 28 has engaged with the security gate 22, and when the trailing edge of the banknote 28 has cleared the security gate 22.

With reference to FIGS. 3 and 5, when the trailing edge of the banknote 28 has cleared the security gate 22 and the tines 22' have returned to their biased position, the leading edge of the banknote 28 continues in the direction 31 until the light transmission of the arcuate light conduit 23 has been broken, at which point the auxiliary PCB 30 has an indication of the exact current position of the banknote 28.

At this point, the motor of the banknote drive module 9 is reversed for a very short, predetermined time period such that the banknote is moved a fractional amount in a direction 31' opposite to direction 31 until the trailing edge (now momentarily the leading edge) is positioned within a security niche 32 positioned underneath the security tines 22'.

Advantageously, the banknote 28 is now accurately positioned over the cashbox ingress aperture 28, so when a stacking procedure is activated, the possibility of the banknote 28 snagging or being torn by incorrect alignment is avoided. In addition, because the downstream entrance to the lower banknote pathway 18 is closed by the return of the security gate 22 to its biased position and, because the trailing edge of the banknote 28 is positioned within the security niche 22, even if the banknote is attached to string or tape, it cannot now be retrieved; any fraudulent attachment will be either stacked with the banknote 28 or detached by the action of the pusher-plate acting on the banknote 28.

A further advantage arises from the fact that even if an external agent, for example a fraudster, is able to force the security gate into its non-biased position (as shown in FIG. 4) by some means, this only increases the hold on the banknote and therefore renders impossible the chance of the banknote being successfully retrieved by the external agent.

Figure 7:
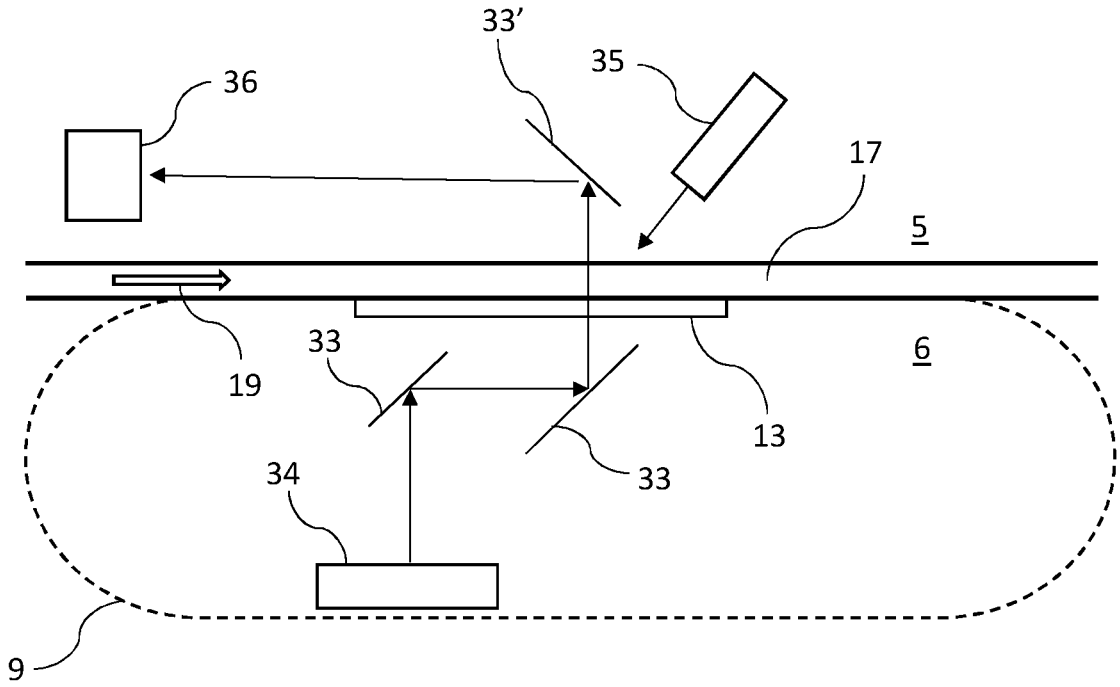
FIG. 7 depicts a schematic of the banknote validator authentication means.

The process of banknote imaging by the acceptor unit 2 will now be described with reference to FIG. 7.

Transmission

A received banknote (not shown) travels in a direction 19 along the upper banknote pathway 17. As the banknote passes the illumination window 13, white light or infrared light emanating from a light source unit 34 is reflected by a pair of reflectors 33 through the illumination window 13 and through the banknote. The transmitted light is then reflected by a third reflector 33' to impinge on the detector of a camera 36 located within the upper housing section 5. In a preferred embodiment, the light source unit includes at least one LED emitting visible light and at least one LED emitting infrared light and these LEDs are activated in an alternate sequence.

Reflection & Fluorescence

A banknote travelling along the upper banknote pathway 17 is also illuminated from above by light transmitted from light source unit 35 located within the upper housing section 5. The light source unit 35 includes at least one LED emitting ultraviolet light. Fluoresced visible light is directed via the third reflector 33' and directed towards the camera 36. The ultraviolet LED of the light source 35 is activated in sequence with the LEDs from the light source 34 such that at any one instant the banknote under investigation is being irradiated by only one LED source from either above or below. In this way, the camera receives a sequence of transmitted light and fluoresced light. The sequence of LED activation is predetermined and controlled by the auxiliary PCB 30.

In an alternative embodiment, an additional visible image may be collected by including a white light LED within the light source 34.

Calibration

The operating gain of the camera 36 needs to be correctly attenuated for the fluoresced light emanating from a banknote. Conventionally, this has been achieved by the inclusion of an opaque reference reflector configured to fluoresce under ultraviolet irradiation. The reference reflector provides the camera with a level of fluorescence (with no banknote present in the light path) which is used to set the optimum operating gain of the camera sensor. Advantageously, the illumination window 13 of the present invention fluoresces under direct illumination by ultraviolet light when no banknote is present. In this way, since the illumination window 13 is transparent to visible light and infrared light, but fluoresces under ultraviolet light, it functions both as a transmission optical element and as a calibration element. This negates the necessity for any additional reference reflectors to be employed in the optical system.

In a preferred embodiment, the camera 36 is an electronic camera that incorporates a rolling shutter image sensor. Preferably, the camera includes a 640×480 VGA CMOS image sensor operating at 30 frames per second at full resolution.

Advantageously, the camera 36 is operated such that it is reset after a 30 pixels by 120 pixels window of the banknote has been imaged. As this is only one quarter of the possible image window for this camera, it can be take images 4 times faster than if it were to use the full extent of the sensor.

What is claimed is:

1. A banknote validator comprising:

a housing;

a validation sensor means; and a banknote drive mechanism;

wherein the banknote drive mechanism is arranged to transport a banknote from an input aperture to a stacking means, said banknote drive mechanism delimiting a first banknote pathway proximal to the input aperture, and a second banknote pathway proximal to the stacking means;

characterised by a pivotable security gate arrangement that is resiliently biased to project into the second banknote pathway; and wherein an optical sensor is disposed in the second banknote pathway at a position in the second banknote pathway distal from the pivotable security gate arrangement.

2. A banknote validator as claimed in claim 1, wherein the pivotable security gate arrangement comprises a plurality of security gate tines.

3. A banknote validator as claimed in claim 2, wherein the plurality of security gate tines is distributed laterally across the second banknote pathway.

4. A banknote validator as claimed in claim 3, wherein a security niche is disposed underneath the plurality of security gate tines in the second banknote pathway.

5. A banknote validator as claimed in claim 4, wherein the stacking means is configured to urge a received banknote from being positioned in the security niche into a secure cashbox.

6. A banknote validator as claimed in claim 1, wherein a cashbox ingress aperture is positioned between the pivotable security gate arrangement and the optical sensor.

7. A banknote validator as claimed in claim 6, wherein the pivotable security gate arrangement is disposed proximal to an end of the cashbox ingress aperture that is upstream in the second banknote pathway.

8. A banknote validator as claimed in claim 1, wherein the validation sensor means includes an image capture window positioned adjacent to the first banknote pathway, wherein the image capture window is transparent to both visible light and infrared radiation, and wherein the image capture window is configured to emit visible fluorescent light when irradiated by ultraviolet light.

9. A banknote validator as claimed in claim 8, wherein the image capture window is constructed from a transparent polypropylene material that incorporates a visible fluorescence substance.

10. A banknote validator as claimed in claim 1, wherein the optical sensor is formed by an arcuate transparent light conduit disposed adjacent to an end of the cashbox ingress aperture that is downstream in the second banknote pathway.

11. A banknote validator as claimed in claim 1, wherein a received banknote travelling along the second banknote pathway travels from an upstream position defined by the location of the pivotable security gate arrangement to a downstream position defined by the location of the optical light sensor.

12. A banknote validator as claimed in claim 11, wherein a received banknote, on reaching the downstream position defined by the location of the optical sensor, is reversed so that a trailing edge of said received banknote is positioned in the security niche to prevent removal of said received banknote from the banknote validator.

* * * * *